US006119988A

United States Patent [19]

Rivas

[11] Patent Number: 6,119,988

[45] Date of Patent: Sep. 19, 2000

[54] FLAT AND PLANAR MATCH SYSTEM BETWEEN RAILS AND FILLERS TO RAILROAD TURNOUTS AND CROSSINGS

[76] Inventor: Arturo A. Ortiz Rivas, Doblado #236 Nte., Monterrey, N.L., Mexico

[21] Appl. No.: 09/173,323

[22] Filed: Oct. 15, 1998

[51] Int. Cl.[7] ..... E01B 7/00

[52] U.S. Cl. ..... 246/454; 246/460; 246/465; 246/472

[58] Field of Search ..... 246/454, 460, 246/461, 462, 463, 465, 468, 470, 471, 472; 238/8, 22

[56] References Cited

U.S. PATENT DOCUMENTS

| | | | |
|---|---|---|---|
| 71,905 | 12/1867 | Park | 246/471 |
| 862,645 | 8/1907 | Lewis | 246/462 |
| 1,072,866 | 9/1913 | McEvoy et al. | 246/460 |
| 1,335,385 | 3/1920 | Mitchell | 246/460 |

*Primary Examiner*—Mark T. Le
*Attorney, Agent, or Firm*—Bracewell & Patterson, L.L.P.

[57] ABSTRACT

The strength and reliability of railroad track structures, such as frogs, crossings, and guardrails, is enhanced. Filler members and filler blocks are fitted in to support and strengthen the structures. The filler members and filler blocks provide better matching and alignment of load transfer surfaces. The track structures with the improved components are more easy to align and assemble. The strength of the assembled track and structures is also increased, and the structures are more easily maintained.

7 Claims, 1 Drawing Sheet

FLAT AND PLANAR MATCH SYSTEM BETWEEN RAILS AND FILLERS TO RAILROAD TURNOUTS AND CROSSINGS

BACKGROUND OF THE INVENTION

1. Field of the Invention

The present invention relates to railroad track components for turnouts, crossings and the like.

2. Description of Prior Art

U.S. Pat. No. 5,765,785 of which Applicant is inventor, provided certain improvements in railroad track crossings. Among these were a new and improved railroad track crossing which included an interchangeable insert. Among the components of the structure were support fillers and filler blocks. These two structural components had vertical contact surfaces on side portions which were adapted to mate with and fit against corresponding flat vertical surfaces formed on the upright web portion of the rail. The support fillers and filler blocks also had downwardly sloping upper and lower surfaces. These sloping surfaces were intended to conform or correspond to the conventional sloped planar surfaces present in rails or other track pieces. These sloped planar surfaces were present in rails below the wheel contact portion of the rail and also on the base portion of the rail.

However, problems have been found to exist. Due to the rolling process of forming rails, these were minor variations in the angles and ratios of these portions of the rail. The dimensions and slope of the vertical flat on the web, and the sloped surfaces below the wheel contact portion and on the base portion and their relative spacing, had minor variations in different rail members and also along the length of any one particular rail member.

It was thus difficult to achieve a proper match between the rails, filler blocks and filler members when track structures such as frogs and crossings were assembled. To the extent that a properly fitted match between these three contact surfaces was not achieved, the relative strength of the assembled structure was reduced, and the service life of the structure decreased. This could in some cases after time pose a possible safety concern.

SUMMARY OF INVENTION

Briefly, the present invention provides new and improved structural components in the form of filler members and filler blocks for railroad track structures. The structures may be, for example, in the form of junctures between adjacent rails and may include frogs, guardrail and crossings.

The filler members according to the present invention are attached to a rail in the railroad track structure for support purposes. The filler members include a filler member body which has a laterally outwardly extending vertical contact surface which engages a corresponding flat vertical surface on a web portion of the rail. The filler members include a leg member extending downwardly from the filler member body. The leg member has a horizontal contact surface for mounting on a corresponding horizontal flat surface formed on a sloped surface of a base portion of the rail. The filler members also have an upwardly extending upright which has a horizontal planar upper contact surface to engage a corresponding horizontal flat surface formed below a head portion of the rail. The engagement of the horizontal and vertical surfaces on the filler member with corresponding surfaces on the rail provides ease of alignment and installation, as well as increased strength and better load transfer.

The filler blocks of the present invention are attached between adjacent rails in the railroad track structure. The filler blocks include a filler block body which has a laterally outwardly extending vertical contact surface formed on it to engage corresponding planar flat vertical surfaces formed on web portions of the adjacent rails. The filler block body has a horizontal lower contact surface on a lower surface for mounting on corresponding horizontal flat surfaces formed on base portions of the adjacent rails. The filler block bodies also have one or more uprights formed extending upwardly, having horizontal upper contact surfaces formed on them. The upper contact surfaces on the uprights engage corresponding horizontal flat surfaces below head portions of the adjacent rails. The engagement of the horizontal and vertical contact surfaces of the filler blocks with corresponding surfaces on the adjacent rails provides ease of alignment and installation, also increasing strength and improving lead transfer.

Railroad structures with filler members and filler blocks according to the present invention thus have increased strength and extended service life. These structures are also more easily aligned and installed, and are more easily maintained.

BRIEF DESCRIPTION OF THE DRAWINGS

The characteristic details of the present invention are clearly shown in the following description and accompany figures, which illustrate this and provide points of reference to indicate the same parts in the figures shown.

DESCRIPTION OF PREFERRED EMBODIMENT

Figure 1:
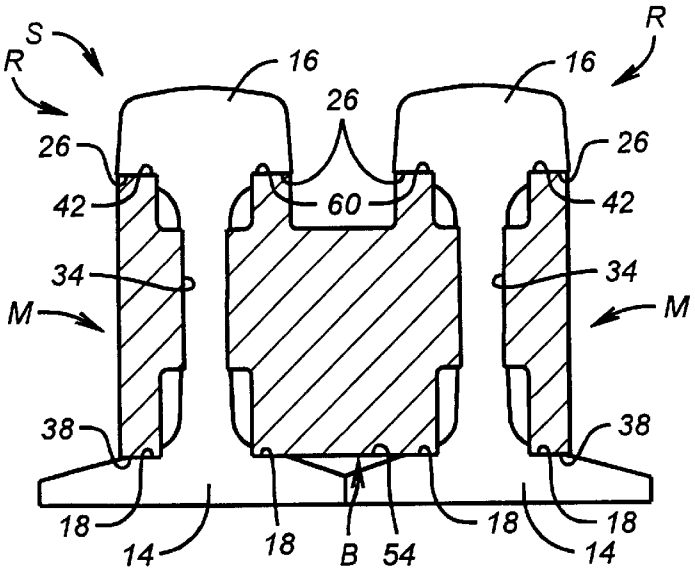
FIG. 1 is a cross-sectional view of a railroad juncture between adjacent rails with filler members and filler blocks according to the present invention.
Figure 2:
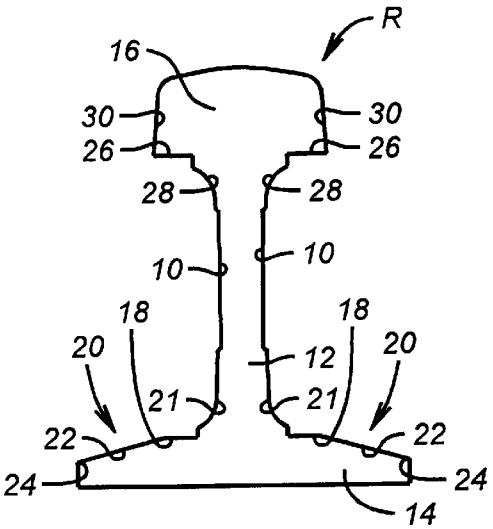
FIG. 2 is a cross-sectional view of one of the rails of FIG. 1.

In the drawings, the letter S designates generally a railroad track structure formed between a pair of adjacent track components, such as rails R. The structure S also includes a pair of filler members M and a filler block body B. The railroad structure S may be a frog, turnout or crossing, as disclosed in U.S. Pat. Nos. 5,765,785; 5,393,019 and 5,303,884, each of which is incorporated herein by reference.

Turning first to the rails R, each of such rails has a flat vertical surface 10 formed on each side of a web portion 12 between a base portion 14 and a head portion 16. The flat vertical surfaces on the rail web 12 are formed in the manner disclosed in Applicant's U.S. Pat. No. 5,765,785, which is incorporated herein by reference. The vertical flat surfaces 10 serve as precise measurement and alignment references for other surfaces formed on the rails R and other components of the structure S, as will be set forth below.

Each of the rails R also includes a horizontal flat surface 18 formed on an intermediate area 20 of each outwardly sloped upper surface 22 of the base portion 14. The flat surfaces 18 are formed in the intermediate areas 20 between a lower radius area 21 of the web portion 12 and a lower side portion 24 of the base portion 14. The flat surfaces 18 are formed in a common horizontal plane which is perpendicular within the accuracy of precision machining tolerances to the vertical plane in which the flat vertical surface 10 of the web portion 12 is formed. Each of the rails R also includes a horizontal flat surface 26 formed on each lower inwardly curving surface or radius 28 beneath the head portion 16. The flat surfaces 26 are formed extending inwardly from a side edge portion 30 at its juncture with the inwardly curving surface 28 below the head portion 16. The flat surfaces 26 of the head portion 16 are formed in a common horizontal plane as shown. The horizontal plane of flat surface 26 is perpendicular within the accuracy of machining tolerances to the vertical plane in which the flat surface 10 of the web portion 12 is formed. The horizontal plane of flat surfaces 26 is thus parallel within the accuracy of machining tolerances to the horizontal plane of the flat surface 18 in the base portion 14.

The filler member M is formed of a suitable strength alloy steel, depending upon the intended load and service usages of the rail structure S. The filler member M has a central filler member body portion 32 of generally rectangular vertical cross-section. The filler member body 32 further has a lateral width equal to the space between the vertical flat surface 10 and side portion 24 of base 14 and side portion 30 of head 16 of the rail R. The filler member body 32 has a laterally outwardly extending vertical contact surface 34 formed thereon for fitting engagement along its vertical extent with the flat surface 10 on the web portion 12 of the rail R.

Figure 4:
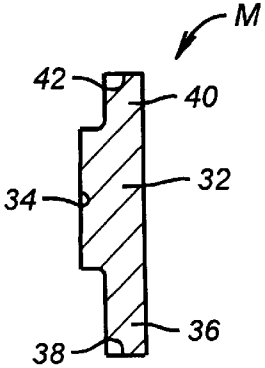
FIGS. 3 and 4 are cross-sectional views of the filler members of FIG. 1.
Figure 3:
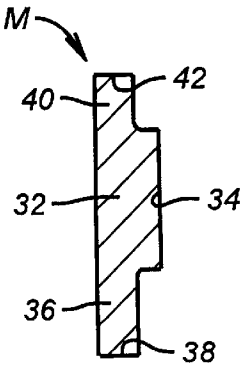
Figure 5:
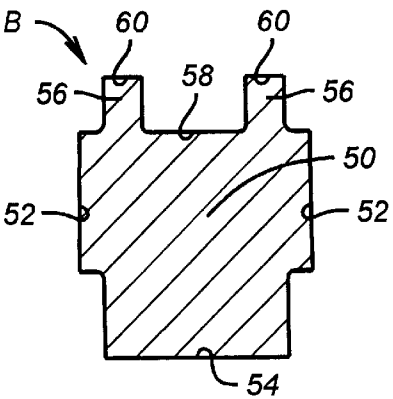
FIG. 5 is a cross-sectional view of the filler block of FIG. 1.

Two filler members M are typically used in each rail structure S. They are normally of like construction, with their relative position in their longitudinal extent along the rails R reversed. The contact surfaces 34 of each filler member M thus face inwardly, as shown in FIGS. 3 and 4, to engage corresponding outwardly facing vertical surfaces 10 of rails R (FIG. 1).

The filler member M also includes a leg member 36 integrally formed with and extending downwardly from the filler member body 32 outwardly from the surface 34. The leg member 36 has a lateral horizontal contact surface 38 formed on it which is perpendicular to the vertical contact surface 34, again within the limits of machine tolerance accuracies. The spacing of the horizontal surface 38 from the vertical surface 34 on the filler member M conforms to the spacing of the surfaces 18 and 10, respectively, on the rail R. In this way, when the vertical surfaces 34 and 10 are in proper engagement, the horizontal surfaces 38 and 18 are also fittedly engaged and aligned in proper engagement.

The filler member M includes an upright 40 integrally formed with and extending upwardly from the body member 32 in alignment with the leg member 36. The upright 40 has a lateral horizontal contact surface 42 formed in it which is perpendicular to the vertical contact surface 34 and parallel to the horizontal surface 38. The spacing of contact surface 42 from vertical surface 34 and horizontal surface 38 on the filler member M conforms to the spacing of horizontal surface 26 from the surfaces 10 and 18 on the rail R. Accordingly, when the vertical surfaces 34 and 10 are fitted against each other, horizontal surfaces 42 and 38 on the filler member M are in engagement and proper contact along their lateral surface extent with the surfaces 26 and 18, respectively, of the rail R.

The length of the filler member M and its extent along the rail structure R with which it is mounted is determined by the nature of the rail structure with which it is to be used and load bearing considerations. A suitable number of connector passage holes are formed in the manner described in U.S. Pat. No. 5,765,785 along the length of the rail R and the filler member M laterally extending therethrough. The connector passages allow bolts and other suitable connecting mechanisms to be inserted to connect these components of the rail structure S with each other.

The filler block body B is formed of a suitable strength alloy steel depending upon intended load and service usage. The filler block B includes a central filler block body 50 of generally rectangular vertical cross-section, having a lateral width substantially equal to the intended spacing between adjacent rails R. More particularly, the filler block body 50 has laterally outwardly extending vertical contact surfaces 52 formed thereon for engagement with corresponding planar flat vertical surfaces 10 on the web portions 12 of the adjacent rails R.

The filler block body 50 also includes a horizontal lower contact surface 54 extending laterally beneath the central portion of the filler block body 50. The lower contact surface 54 is adapted for mounting on and in engagement with horizontal flat surfaces 18 on facing portions of adjacent rails R in the structure S. The horizontal contact surface 54 is perpendicular to the vertical contact surface 52 of the filler block body 50 within the limits of machining tolerance accuracy. The spacing of the vertical surfaces 52 of the filler block body 50 from the horizontal contact surface 54 conforms to the spacing of the inwardly facing surfaces 18 and 10 formed on the adjacent rails R in the structure S. When the vertical surfaces 52 on the filler block body 50 are brought into contact with the vertical flat surfaces 10 of the adjacent rails R, and are in proper engagement, the horizontal flat surface 54 of the filler block B is fittingly engaged with the horizontal contact surfaces 18 of the adjacent rails R. The components of the rail structure S are thus in proper, load bearing and load transfer fitting engagement.

The filler block B also includes a pair of vertically extending uprights 56 formed on the filler block body 50. The uprights 56 are formed at spaced positions on an upper surface 58 of the filler block body 50 corresponding to the required spacing between the inwardly facing horizontal contact surfaces 26 of adjacent rails R in the structure S. Each of the uprights 56 has a horizontal upright contact surface 60 formed thereon for engaging a corresponding one of the horizontal flat surfaces 26 of the adjacent rails R in the structure S.

The spacing of the horizontal contact surfaces 60 from the vertical surfaces 52 on the filler block 50 corresponds to the spacing of the surfaces 26 and 10 in the rails R. When the vertical surfaces 52 are fitted against the rail surfaces 10, the horizontal contact surfaces 60 are in load bearing engagement with the surfaces 26 beneath the head portion 16 of the rails R.

Again, the length of the filler block body 50 is determined by the nature of the rail structure S with which the filler block B is to be used. Also, a suitable number of laterally extending connector openings are formed in and along the length of the filler block B. The openings so formed are for alignment with and connection to bolts or other suitable connecting mechanisms inserted through corresponding connector passages or openings in the rails R and the filler member M. In this way, the structural components of the rail structure S are connected together. When so connected, the contact surfaces of the filler members M and filler block B, particularly the horizontal ones, are in firm, load transfer position with corresponding surfaces of the rails R. The amount and extent of this load bearing contact offsets any possible weakening of the rails R due to the formation of contact surfaces on them. Further, the flat surfaces 26 and 18 are not formed in the areas 28 and 21 of rails R of the radius between the head and base portions, respectively, and the web 12. Thus, machining the flat surfaces 26 and 18 in the rails R does not significantly reduce their strength.

Both the filler members M and the filler block B can be made from less expensive conventional steel than the rails R, since they are spaced from contact with railroad wheels, and thus are not subject to repeated impact and high wear.

The present invention thus allows the easy and precise manufacture of bars and fillers. Further, these pieces have a service life limited only by the steel life, since is quite difficult for these parts to become broken or worn during use. This means savings in time, money, and security in operation for the frogs, crossings, and guard rails.

The improved design of the present invention also provides a reference point which is the base for accuracy in assembly and manufacture of every part of a track component such as frogs, crossing or guard rails, at the same time strengthening the head rail resistance due to impact and loads to the matching planar surfaces in three separate locations between the rail R and the fillers.

Having described the invention above, various modifications of the techniques, procedures, material and equipment will be apparent to those in the art. It is intended that all such variations within the scope and spirit of the appended be embraced thereby.

What is claimed is:

1. A railroad track structure, comprising:

a pair of adjacent rails;

a filler member body;

said filler member body having a laterally outwardly extending vertical contact surface thereon for engaging a corresponding flat vertical surface on a web portion of one of the rails;

a leg member extending downwardly from said filler member body;

said leg member having a horizontal contact surface thereon for mounting on a corresponding horizontal flat surface formed on a sloped surface of a base portion of the rail with which the filler member is mounted;

a filler block body;

said filler block body having laterally outwardly extending vertical contact surfaces formed thereon for engaging corresponding planar flat vertical surfaces on web portions of the adjacent rails; and said filler block body having a horizontal lower contact surface on a lower surface for mounting on corresponding horizontal flat surfaces formed on base portions of the adjacent rails.

2. The railroad track structure of claim 1, further including:

an upright formed on said filler member body having a horizontal upper contact surface thereon for engaging a corresponding horizontal flat surface below a head portion of the rail; and an upright formed on said filler block body having a horizontal upper contact surface thereon for engaging corresponding horizontal flat surfaces below a head portion of the rail.

3. The railroad track structure of claim 2, wherein the structure is a railroad juncture.

4. The railroad track structure of claim 3, wherein the juncture is a crossing.

5. The railroad track structure of claim 3, wherein the juncture is a frog.

6. The railroad track structure of claim 3, wherein the juncture is a guardrail.

7. A railroad track structure, comprising:

a pair of adjacent rails;

a filler member body;

said filler member body having a laterally outwardly extending vertical contact surface thereon for engaging a corresponding flat vertical surface on a web portion of one of the rails;

an upright formed on said filler member body having a horizontal upper contact surface thereon for engaging a corresponding horizontal flat surface below a head portion of the rail;

a filler block body;

said filler block body having laterally outwardly extending vertical contact surfaces formed thereon for engaging corresponding planar flat vertical surfaces on web portions of the adjacent rails; and an upright formed on said filler block body having a horizontal upper contact surface thereon for engaging corresponding horizontal flat surfaces below a head portion of one of the rails.

* * * * *